US009694952B2

(12) United States Patent
Basconnet

(10) Patent No.: US 9,694,952 B2
(45) Date of Patent: Jul. 4, 2017

(54) METHOD FOR MANUFACTURING A LARGE-CAPACITY FLEXIBLE CONTAINER, FLEXIBLE CONTAINER OBTAINED, AND CORRESPONDING PACKAGING

(71) Applicant: TISZA TEXTIL PACKAGING, Chaumont (FR)

(72) Inventor: Jacques Basconnet, Chateauvillain (FR)

(73) Assignee: TISZA TEXTIL PACKAGING, Chaumont (FR)

( * ) Notice: Subject to any disclaimer, the term of this patent is extended or adjusted under 35 U.S.C. 154(b) by 560 days.

(21) Appl. No.: 14/356,239

(22) PCT Filed: Nov. 5, 2012

(86) PCT No.: PCT/FR2012/052548
§ 371 (c)(1),
(2) Date: May 5, 2014

(87) PCT Pub. No.: WO2013/068680
PCT Pub. Date: May 16, 2013

(65) Prior Publication Data

US 2014/0376831 A1 Dec. 25, 2014

(30) Foreign Application Priority Data

Nov. 7, 2011 (FR) ..... 11 60103

(51) Int. Cl.
*B31B 37/00* (2006.01)
*B31B 1/16* (2006.01)
(Continued)

(52) U.S. Cl.
CPC ..... *B65D 47/06* (2013.01); *B31B 1/16* (2013.01); *B31B 1/26* (2013.01); *B31B 1/74* (2013.01);
(Continued)

(58) Field of Classification Search
CPC .. B31B 37/00; B31B 1/16; B31B 1/26; B31B 1/74; B31B 1/86; B65D 47/06
(Continued)

(56) References Cited

U.S. PATENT DOCUMENTS 4,596,040 A * 6/1986 LaFleur ..... B65D 88/1681 383/42
4,781,472 A * 11/1988 LaFleur ..... B65D 88/1618 383/105
(Continued)

FOREIGN PATENT DOCUMENTS

| | | |
|---|---|---|
| FR | 1051406 | 1/1954 |
| FR | 2 956 834 | 9/2011 |
| WO | 2011/104485 | 9/2011 |

OTHER PUBLICATIONS

International Search Report dated Apr. 2, 2013, corresponding to PCT/FR2012/052548.

*Primary Examiner* — Andrew M Tecco
*Assistant Examiner* — Praachi M Pathak
(74) *Attorney, Agent, or Firm* — Young & Thompson

(57) ABSTRACT

A method for manufacturing a flexible container including a body, a base including an emptying spout and a cover including a filling spout, includes: cutting, from a sheet of flexible material, four main panels of the body and the base and four cover panels, each main panel having a square or rectangular shape having four sides, the bottom side being extended by an approximately trapezoidal extension, whose end towards the bottom is extended by a tab, the extension and tab forming the base and emptying spout, each cover panel having a substantially trapezoidal shape with a base towards the bottom and whose end towards the top is extended by a tongue forming the filling spout; forming a fold in each main panel along the top side; fixing the fold to form at least one loop per main panel; assembling and
(Continued)

Figure 1:
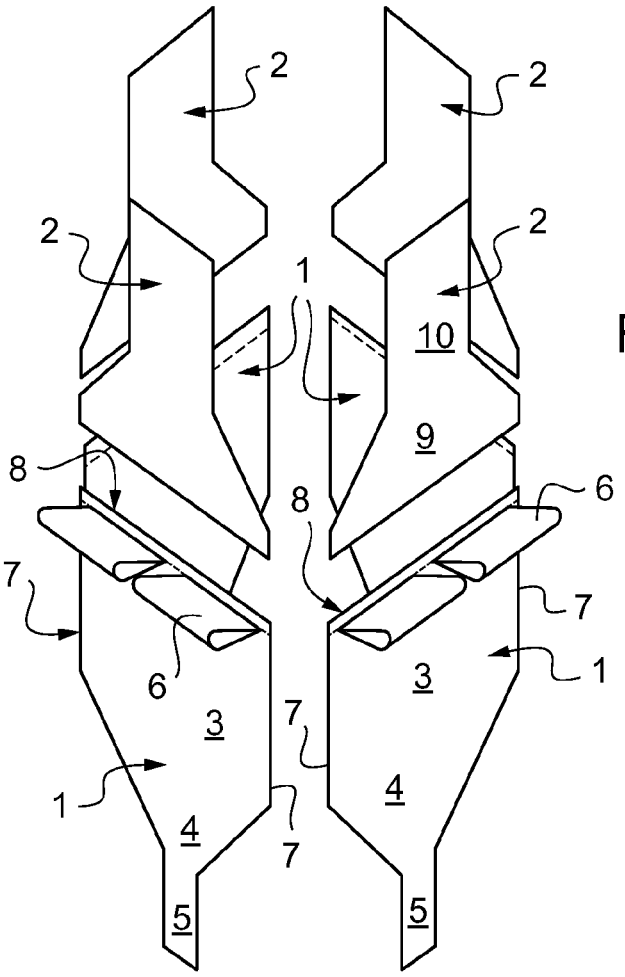

securing together the four main panels and four cover panels.

13 Claims, 4 Drawing Sheets

(51) Int. Cl.
*B31B 1/26* (2006.01)
*B31B 1/74* (2006.01)
*B31B 1/86* (2006.01)
*B65D 47/06* (2006.01)
*B65D 90/20* (2006.01)

(52) U.S. Cl.
CPC ..... *B31B 1/86* (2013.01); *B65D 90/205* (2013.01); *B31B 2221/25* (2013.01); *B31B 2221/50* (2013.01)

(58) Field of Classification Search
USPC ..... 493/210, 215, 217, 294, 297, 386, 379; 53/175
See application file for complete search history.

(56) References Cited

U.S. PATENT DOCUMENTS 4,874,258 A * 10/1989 Marino ..... B65D 88/1618 383/111
5,607,237 A * 3/1997 LaFleur ..... B65D 88/1681 383/117
5,618,254 A * 4/1997 Derby ..... B26D 3/10 493/197
6,139,482 A * 10/2000 Lafleur ..... B65D 88/1618 493/210
6,371,646 B1 * 4/2002 LaFleur ..... B29C 66/004 383/109
7,125,168 B2 * 10/2006 La Fleur ..... B65D 88/1618 383/111
9,199,424 B2 * 12/2015 Basconnet ..... B31B 37/00
2004/0120612 A1 * 6/2004 La Fleur ..... B65D 88/1618 383/111
2008/0283524 A1 11/2008 Kosich
2012/0312865 A1 * 12/2012 Basconnet ..... B31B 37/00 229/72
2014/0376831 A1 * 12/2014 Basconnet ..... B65D 90/205 383/6

* cited by examiner

Fig.8a
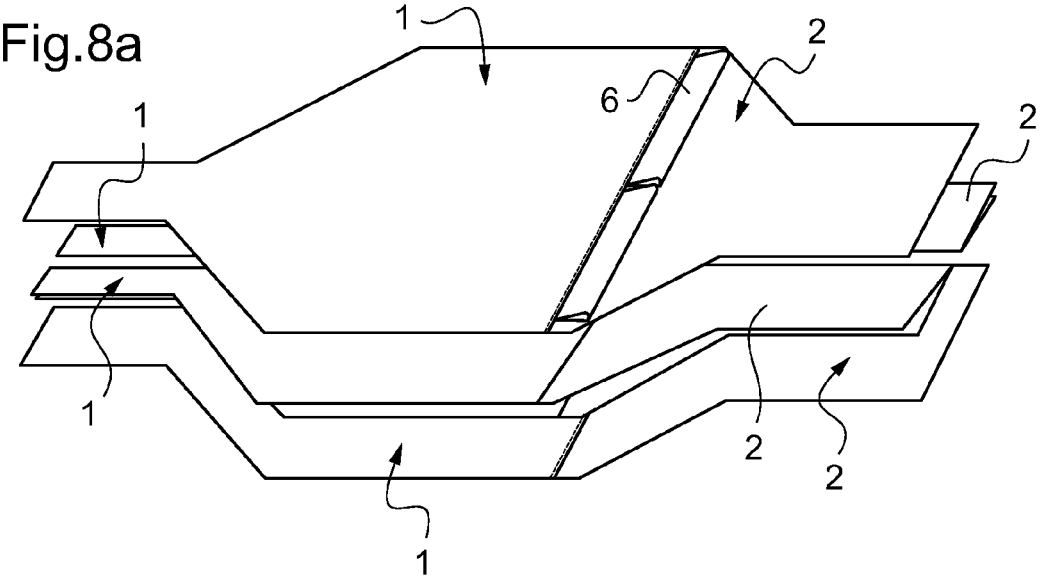
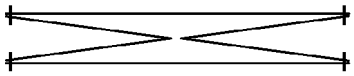
Fig.8b
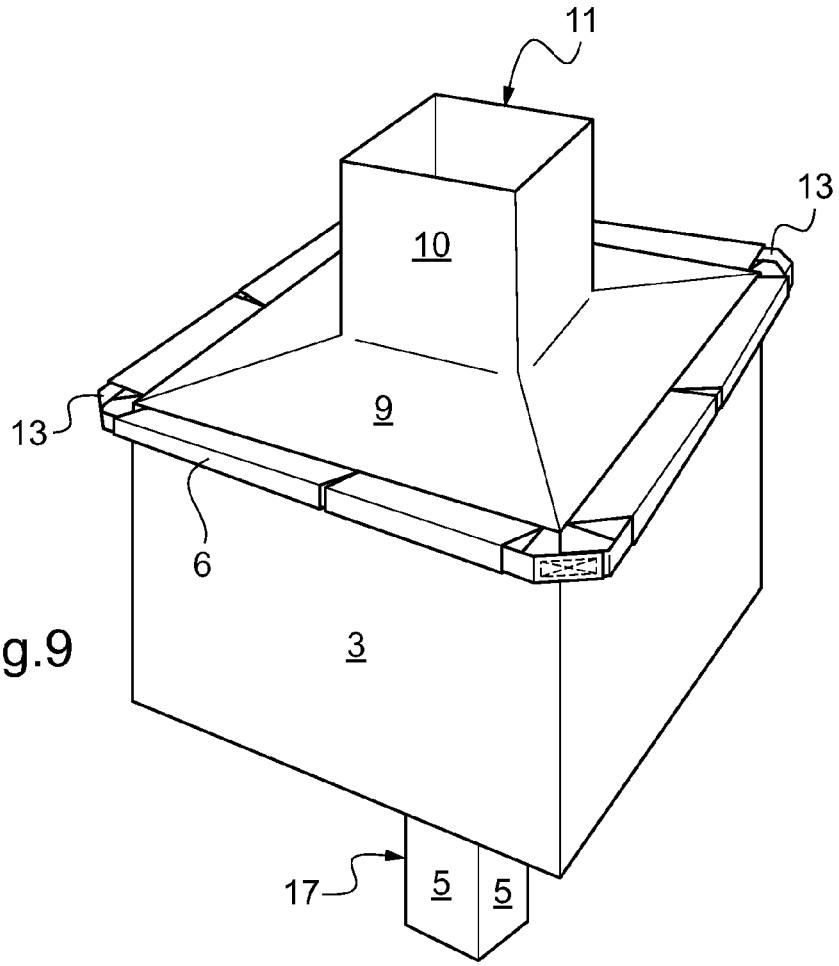
Fig.9

METHOD FOR MANUFACTURING A LARGE-CAPACITY FLEXIBLE CONTAINER, FLEXIBLE CONTAINER OBTAINED, AND CORRESPONDING PACKAGING

The invention relates to a method for manufacturing a large-capacity flexible container, the flexible container obtained by the method, as well as a corresponding packaging. It has applications in the field of packaging.

The large-capacity flexible containers are used for example in the pharmaceutical industry or the chemical industry.

They are intended to contain, for example, half-finished products or finished products in solid form as powders, granulates, tablets, or capsules.

They are generally made of plastic material, for example woven polymer as polypropylene, or possibly of composite material, for example laminate or sandwich of sheets of plastic material, and have capacities from 100 L to more than 600 L and can support a load that can go from a few tens of kilograms to more than 500 kg.

Generally, in order to form a packaging, an inner protective envelop intended to better protect the content thereof is inserted inside the flexible container.

The thus-realized packaging, consisted of the container and the inner protective envelope thereof, is disposable after use, which allows guaranteeing its perfect property because it is used only one time. Such characteristic avoids the risks of contamination, unlike the reusable rigid containers that have to be cleaned, disinfected, identified. Moreover, given the flexibility of the packaging, it is possible to store it in a folded state when it is empty, which reduces the space requirement. It results therefrom that the unitary cost of use is finally much lower and makes it possible to be freed from the risk of mixing between successive contents.

The different parts of the container are obtained by cutting a sheet of material, and these different parts are then assembled to each other. This assembly may be made by seaming but it is also possible to implement, combined or not with seaming, a welding and/or gluing, making it possible to obtain an improved tightness.

It may be noticed that, in demanding applications, the inner protective envelop, commonly called pouch or "liner", ensures the tightness and must be one hundred percent tight. In the packaging obtained, it has for function to protect the content of the flexible container from its environment (humidity, odour, light, gas).

The inner protective envelop is made of a polymer material, such as polyethylene, for example. It may also be made from more noble materials, such as the laminated complexes based on aluminum, polyamide or technical plastic materials, providing it with more specific properties.

The materials used and the method for manufacturing the inner protective envelops have to satisfy the standards of the pharmaceutical industry, and in particular the constraints relating to the cleanness, the absence of pollution and the absence of germs.

Typically, the known large-capacity flexible containers have a parallelepiped shape with a square or rectangular cross-section and are intended to be inserted in a metal frame and supported by the latter. For example, the application FR10/51 406 (FR2 956 834) explains a method for manufacturing a large-capacity flexible packaging of rectangular cross-section. A flexible packaging is also presented in the document US2008/283524A1.

The present invention proposes a method for making a flexible container that is simplified and that makes it possible to obtain a flexible container of particular shape.

Therefore, the invention firstly relates to a method for manufacturing a large-capacity flexible container including a body with, downwards, a bottom comprising an emptying spout, and upwards, a cover, the cover including a filling spout.

According to the invention, the method consists in:

- cutting out from a sheet of flexible material, on the one hand, four main panels, and on the other hand, four cover panels, the main panels being intended to form the body and the bottom and the emptying spout of the container, the cover panels being intended to close the top of the container while forming the filling spout, each of the main panels having in part a square or rectangular shape with four sides, i.e. two lateral sides, one upper side and one lower side, a shape whose lower side is continued by a substantially trapezoidal extension whose downward apex is continued by a tab, the extension and the tab being intended to form the bottom and the emptying spout of the container, each of the cover panels having in part a substantially trapezoidal shape with a downward base and whose upward apex is continued by a tongue, the tongue being intended to form the filling spout extended upwards,
- forming a fold in each of the main panels along the upper side, opposite to the side of the extension,
- fixing said fold to form at least one loop per main panel,
- assembling to each other the four main panels and the four cover panels, the folds being arranged on the outside of the container, the base of each cover panel being assembled to the upper side of the corresponding main panel, the main panels being assembled two-by-two at least along their lateral sides and their corresponding extensions, the lateral sides in correspondence of the cover panels being assembled to each other two-by-two, the upper ends of the tongues being left free so as to form an upper opening of filling spout, substantially square in shape.

In various possible embodiments, the present invention also relates to the following characteristics, which may be considered in isolation or in any technically possible combination and which each offer specific advantages:

- the main panels are identical to each other,
- the cover panels are identical to each other,
- the portion of substantially trapezoidal shape of the cover panel is configured so as to form a substantially planar or horizontal portion of the cover of the container,
- the portion of substantially trapezoidal shape of the cover panel is configured so as to form a portion substantially inclined towards the top and the center of the cover of the container,
- the substantially trapezoidal extension of the main panel is configured so as to form a substantially planar or horizontal portion of the bottom of the container,
- the substantially trapezoidal extension of the main panel is configured so as to form a portion substantially inclined towards the bottom and the center of the bottom of the container,
- the main panels are cut out individually,
- the cover panels are cut out individually,
- the main panels and the cover panels are cut out individually and a main panel is then assembled and fastened to a cover panel to form one of the four sides of the container, four sides of the container being then assembled and fastened to each other to form the cover, the body and the bottom of the container, the main panels are cut out individually and are then assembled and fastened to each other to form the body and the bottom of the container, the main panels are cut out by pairs, each pair including two main panels remaining attached by their common body lateral edges, and the two pairs being then assembled to each other to form the body and the bottom of the container, the main panels are cut out in two forms, a first form including three main panels remaining attached two-by-two by their common body lateral edges, and a second form corresponding to an individual main panel, and the two forms are then assembled to each other to form the body and the bottom of the container, the main panels are cut out in a single form including four main panels remaining attached two-by-two by their common body lateral edges, the two opposite extreme lateral edges of the form being then assembled to each other to form the body and the bottom of the container, the cover panels are cut out individually and are then assembled and fastened to each other to form the cover of the container, the cover panels are cut out by pairs, each pair including two cover panels remaining attached by a portion of their common lateral edges, and the two pairs being then assembled to each other to form the cover of the container, the cover panels are cut out in two forms, a first form including three cover panels remaining attached two-by-two by portions of their common lateral edges, and a second form corresponding to an individual cover panel, and the two forms being then assembled to each other to form the cover of the container, the cover panels a cut out in a single form including four cover panels remaining attached two-by-two by portions of their common lateral edges, the two opposite extreme lateral edges of the form being assembled to each other to form the cover of the container, the cover panel(s), individual or not, and the main panel (s), individual or not, are cut out so as to form separated panels of the cover or main type, which have then to be assembled to each other, the cover panel(s), individual or not, and the main panel (s), individual or not, are cut out so as to form composite panels including a part of the cover type and a part of the main type, remaining attached by at least their respective lower/base and upper edges, the tabs continuing the extensions of the main panels are also assembled between said main panels to form a closed bottom, the tabs continuing the extensions of the main panels are further intended to form an emptying spout, said tabs being assembled accordingly, the lower ends of the tabs being left free so as to form a lower opening of emptying spout, substantially square in shape, the fold is at a predetermined distance from the upper side of the main panel, the fold is on the edge of the upper side of the main panel, the fold is transversely divided into several portions by openings pierced through the main panel so as to form a determined number of loops per main panel, a belt intended to form a continuous ring around the container is passed through the loops, the belt forming a continuous ring results from the seaming together of ends of strap segments, the belt forming a continuous ring results from the seaming together of the two ends of a strap, the fold is pierced by openings intended to allow the passage of pins protruding from the upper flange of a metal frame intended to support the container, the fixation of the fold and/or the fastening of the panels correspond to one or several of the following operations: seaming, welding, gluing, the welding is made by heat welding, the cutting is made using ultrasounds or by means of a hot blade, the fixation of the fold and the fastening of the panels correspond to a seaming operation, the flexible material is a sheet of polymer, the sheet of polymer is a woven polymer, the polymer is coated polypropylene, the basis weight of the cover panel is identical to the basis weight of the cover panel, the basis weight of the cover panel is different from the basis weight of the cover panel, the basis weight of the cover panel is lower than the basis weight of the cover panel, the basis weight of the cover panel is comprised between 65 and 75 g/m$^2$, the basis weight of the main panel is comprised between 90 and 120 g/m$^2$.

The invention also relates to a large-capacity flexible container obtained by the described method, said flexible container including a body with, downwards, a bottom, and upwards, a cover, the cover including a filling spout having an upper spout opening that is substantially square in shape, the container including fixation means of the loop type, corresponding to folds formed and fixed in the walls of the body of said flexible container.

The invention also relates to a packaging that is externally consisted of a large-capacity flexible container as described herein, and internally, of a tight inner protective envelope including an opening in relation with the filling spout of the cover.

The packaging is placed in a metal frame and is maintained unfolded in said metal frame thanks to loops made in the main panels forming the body of the flexible container and to a belt forming a continuous ring around the container and that is passed through the loops.

Figure 2:
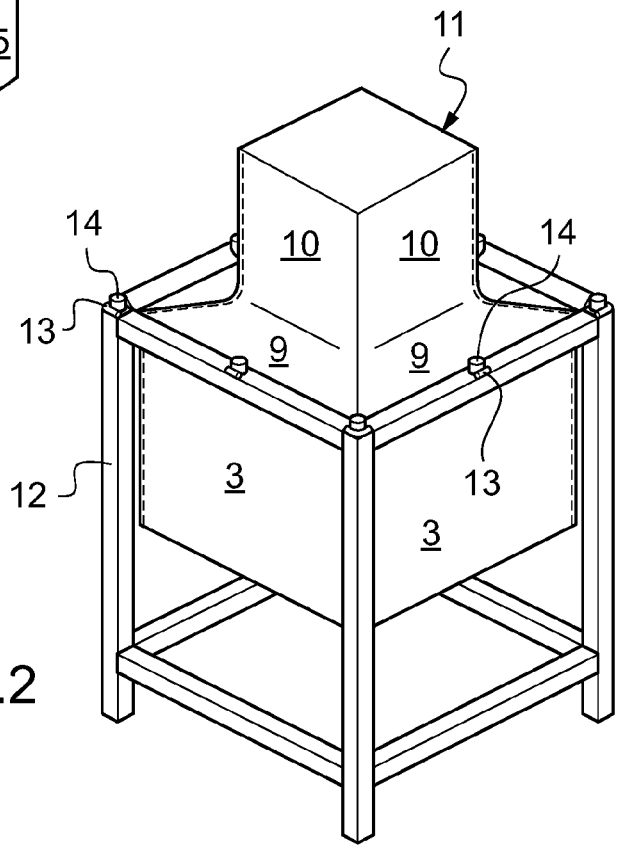
Figure 3:
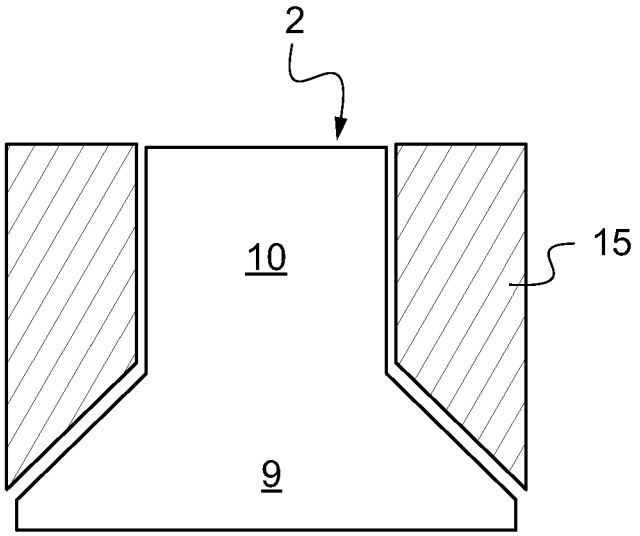
Figure 4:
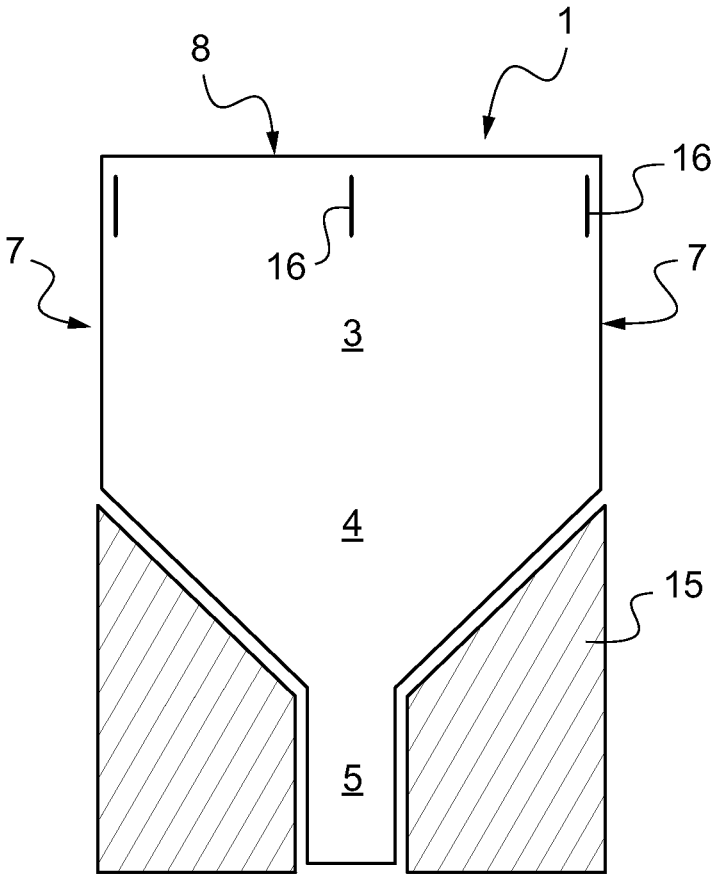
Figure 5:
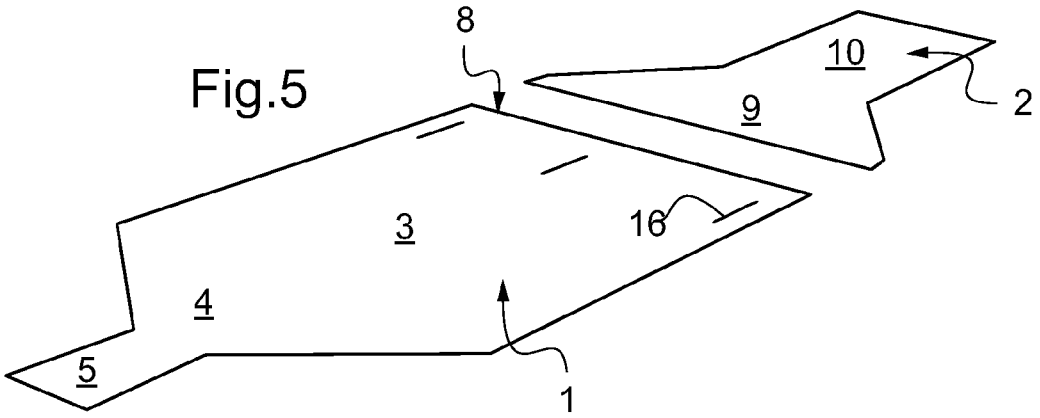
Figure 6:
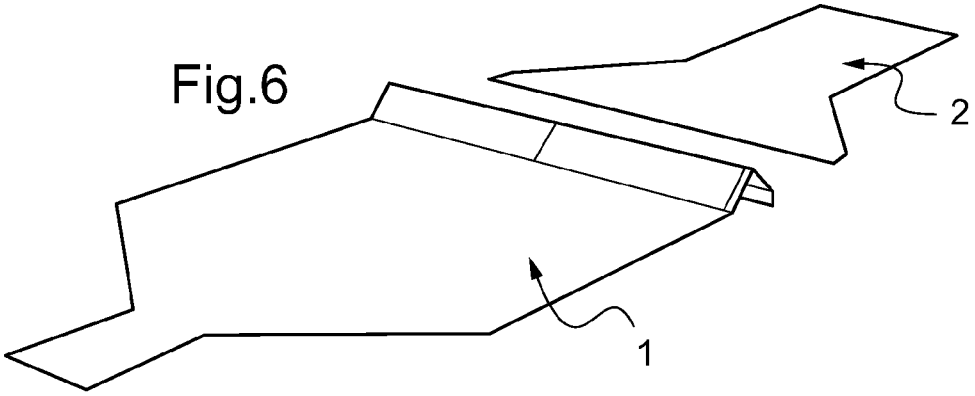
Figure 7:
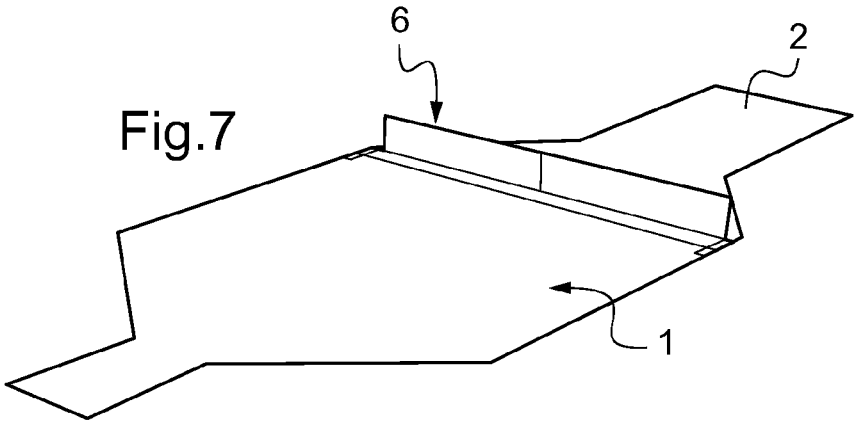

The invention will be described in more detail with reference to the appended drawing in which:

FIG. 1 shows an exploded view of a flexible container according to the invention, FIG. 2 shows a flexible container, unfolded and maintained by a metal frame, FIG. 3 shows the cutting of a sheet of flexible material to form a cover panel, FIG. 4 shows the cutting of a sheet of flexible material to form a main panel, FIGS. 5, 6 and 7 show the steps of preparation and fastening of the main panel and the cover panel, FIGS. 8*a* and 8*b* show the technique of assembly of the panels to form the container, and FIG. 9 shows a flexible container obtained, with a maintaining belt passed through the loops thereof.

The large-capacity flexible container of the invention is intended to be inserted in a metal frame that serves as a supporting structure, in which the flexible container is maintained unfolded thanks to its fixation/maintaining means of the loop type. A unit is hence obtained, having a format that can be easily integrated in standard storage racks, and that can be adapted to the different filling and emptying systems notably of the pharmaceutical industry.

In FIG. 1, four main panels 1 and four cover panels 2 have been cut out individually from a sheet of flexible material. These panels are arranged in such a way to provide an exploded view of the flexible container of the invention. Each main panel 1 includes a portion 3 of square or rectangular shape with four sides, i.e. two lateral sides 7, one upper side 8 and one lower side, which is virtual because the lower side is continued by a substantially trapezoidal extension 4 whose apex is continued by a tab 5, the extension and the tab being intended to form the bottom of the container. The portion 3 of square or rectangular shape is intended to form a lateral face of the container. According to the way the tabs are fastened to each other, it may be obtained a closed bottom or, preferably, a bottom with an emptying spout. The upper end of the portion 3 of the main panel has been cut out 16 and folded on itself so as to form folds 6, seamed to be maintained, corresponding to loops through which a belt (not shown in FIG. 1) is passed.

Each cover panel 2 includes a portion 9 of substantially trapezoidal shape, with a downward base and whose upward apex is continued by a tongue 10, the tongue being intended to form a filling spout extended upwards.

The base of the portion 9 of each cover panel 2 is intended to be fastened, preferably by seaming, to the upper side 8 of the main panel 1. The adjacent sides in correspondence of the main panels, on the one hand, and of the cover panels, on the other hand, are intended to be fastened together, preferably by seaming.

As shown in FIG. 2, once the panels fastened together, a flexible container is obtained, which can be maintained unfolded on a metal frame 12, thanks to a belt 13 passed through the loops 6 and coming into engagement on studs 14 of the metal frame 12. The upper opening of the filling spout 11 is shown open in FIG. 2.

As shown in FIG. 3, the cover panel 2 is obtained by cutting a sheet of flexible material in the indicated shape, which leaves material scraps 15. The same is true for the main panel 1 as shown in FIG. 4, on which cuts 16 are made to form openings between the loops, as will be seen hereinafter.

Typically, the sheet of the material used is in the form of a roll that is unwound. It will be understood that it is possible to implement cutting optimization means so as to reduce the surface of the scraps, in particular by using wide sheets on which the panels are judiciously arranged, in particular staggered, to reduce the scraps. However, if the materiel of the sheet is oriented, for example if a direction exists for which the resistance to traction is maximal, this will be taken into account in the distribution of the elements to be cut out. Moreover, some annex operations may be provided in the case of certain materials, as for example the possible hot melting/cauterization of the edge of each cut-out part in the case of a woven material.

The cutting of the sheet of material may be made using ultrasounds, in particular mobile ultrasound knives, so as to avoid development of smokes and the use of suction hoods. Alternatively, the cutting may be made by a hot-blade technique (350° C.). Other known cutting techniques, as for example water jet, laser or mechanical techniques, may also be used. It will be noticed that, in the case of hot-blade or ultrasound cutting, the melting/cauterization of the edge is made during the cutting, which also allow eliminating the pollutions by detachment of fibers in the case where the sheet of material is a woven material.

Typically, the sheet of material is a coated polypropylene cloth supplied as rolls and this cloth is cut on special machines. Preferably, the basis weight of the cover panel is comprised between 65 and 75 g/m$^2$ and the basis weight of the main panel is comprised between 90 and 120 g/m$^2$, a value that can be adapted to the expected load. Indeed, the mechanical constraints undergone by the different panels are different. The main panels support the main part of the load and ensure the fixation to the support frame, the cover panels are a simple protection of the content and in particular of the inner envelop and they allow to close the packaging after the filling. In a variant, the basis weight is the same for the two types of panels, which makes it possible to use a single type of sheet of material and to optimize the cutting, in particular by making mixed cover+body+bottom panels.

FIGS. 5, 6 and 7 show the steps of preparation and fastening of the main panel 1 to the corresponding cover panel 2. The preparation corresponds to cuttings 16 and to a folding of the main panel towards its upper edge 8, then an immobilization of the fold obtained by seaming so as to form the loops 6. The fastening corresponds to the placement of the upper edge 8 of the main panel 1 in relation with the base, or lower edge, of the cover panel 2, and the seaming thereof. An element corresponding to one of the four faces/sides of the flexible container is thus obtained.

In a variant, instead of making individual panels, which are then fastened to each other, a mixed panel is made, including the main panel and the cover panel, i.e. the two panels in question of the sheet are not separated along the upper edge (main panel) and the base (cover panel) during the cutting of the sheet.

From four elements each corresponding to main and cover panels fastened to each other, a bellows assembly is made, as shown in perspective in FIG. 8*a* and in cross-section in FIG. 8*b*. The corresponding lateral edges of the panels of the elements are seamed two-by-two. In this embodiment with an emptying spout, the seams are made all along the lateral edges of the panels. On the other hand, the upper ends of the tongues 10 are left free so as to form the upper opening of the filling spout 11, which is substantially square in shape. Likewise, the lower ends of the tabs 5 are left free so as to form a lower opening of emptying spout 17 that is substantially square in shape. This is during this step of final assembly that the inner protective envelop is installed to obtain a tight packaging. These operations can be performed in horizontal position.

A belt 13 is passed through the loops 6, as can be seen in FIG. 9. This belt is preferentially made by seaming one or several strap segments to each other so as to form a belt that is a continuous ring. It can be noticed that, with the method of the invention, it is not necessary to add fixation tabs on the flexible container, by welding or gluing, because the fixation means in the form of loops are simply obtained by folding and fixation/immobilization of a portion of the material of the flexible container.

The fastening of the panels to each other is preferentially made by seaming but other techniques are possible, such as welding or gluing, which may possibly be combined together. The welding operations, in the case where they are performed, are made by heat welding. It is to be noted that the seaming and the welding can be associated to improve the tightness, preferably a band of material covering at least one face of the seam being welded on the latter so that at least one of the faces of the seam is isolated from the environment. The band of material is preferably a fold of an edge of one of the seamed panels, the seaming having been made remote from this edge. It can be provided that the two seamed panels each have such a folded band, which allows the tightness to be obtained on the two faces of the seam. As an alternative, an added band of specific material is welded on the seam.

The example of implementation of the invention that has just been described has used during the manufacturing four identical individual main panels and four identical individual cover panels, which are fastened together. It is understood that it is also possible to make a flexible container using panels that are single-piece, forming for example two main panels or three main panels. For that purpose, instead of cutting individual panels out from the sheet of a flexible material, two or three main panels are left attached to each other. It is understood that this technique is essentially useful for the main panels that have relatively long lateral sides in correspondence.

As a function of the shape of the cut main panels, it is possible to make large-capacity flexible containers of various volume shapes. It is for example possible to make large-capacity flexible containers of parallelepiped shape, with a rectangular cross-section of 68×108 mm, intended to be placed in metal frames of 79×119 mm.

Hence, using pairs of panels of different sizes, it is possible to make containers of more or less elongated shapes in horizontal direction, thus having a rectangular shape in horizontal cross-section instead of a square shape with identical panels. The height of the container also depends on the square or rectangular shape and of the dimensions of the main panels. The shape of the spout openings can be modified accordingly and be rectangular instead of square in shape.

To make a tight packaging, an inner protective envelop is placed inside the container. This inner protective envelop is obtained by extrusion-blowing of polyethylene, whose final shape is given by cutting and hot welding. This inner protective envelop that includes flaps becomes integrated into the container during the final phase of assembly of the panels so that the flaps are taken in sandwich in the seams of the lateral sides of the panels, essentially main panels.

At the end of manufacturing of a packaging, container+ inner protective envelop, the packaging may be folded flat along the natural ridges thereof. The volume occupied by this void packaging is then relatively small with respect to other known packaging types.

Of course, the present invention is not limited to the particular embodiments that have just been described, but extends to any variants and equivalents in the spirit thereof. Hence, it is well understood that the invention can be declined according to many other possibilities, without thereby departing from the scope defined by the description and the claims. For example, the method for making the container may be used for making the inner protective envelop that is installed in the container, except that, in this case, it is not necessary to make the folds of the main panels and, in this case of manufacturing of the inner protective envelop, a welding of the panels to each other is preferably implemented to obtain tightness.

The invention claimed is:

1. A method for manufacturing a large-capacity flexible container including a body with, downwards, a bottom comprising an emptying spout, and upwards, a cover, the cover including a filling spout, the method comprising:

cutting out from a sheet of flexible material four main panels (1), and four cover panels (2), the main panels being intended to form the body and the bottom comprising the emptying spout of the container, the cover panels being intended to close the top of the container while forming the filling spout (11), each of the main panels having in part a square or rectangular shape (3) with four sides, comprising two lateral sides (7), one upper side (8) and one lower side, a shape whose lower side is continued by a substantially trapezoidal extension (4) whose downward apex is continued by a tab (5), the extension and the tab being intended to form the bottom and the emptying spout of the container, each of the cover panels having in part a substantially trapezoidal shape (9) with a downward base and whose upward apex is continued by a tongue (10), the tongue being intended to form the filling spout extended upwards, forming a fold (6) in each of the main panels along the upper side, opposite to the side of the extension, fixing said fold to form at least one loop per main panel, and assembling and fastening to each other the four main panels and the four cover panels, the folds being arranged on the outside of the container, the base of each cover panel being assembled to the upper side of the corresponding main panel, the main panels being assembled two-by-two at least along their lateral sides and their corresponding extensions, the lateral sides in correspondence of the cover panels being assembled two-by-two to each other, the upper ends of the tongues being left free so as to form an upper opening of the filling spout, substantially square in shape.

2. The method according to claim 1, wherein the main panels (1) are identical to each other, and the cover panels (2) are identical to each other.

3. The method according to claim 2, wherein the portion (9) of substantially trapezoidal shape of the cover panel (2) is configured so as to form a substantially planar or horizontal portion of the cover of the container.

4. The method according to claim 2, wherein the main panels (1) and the cover panels (2) are cut individually and a main panel is then assembled and fastened to a cover panel to form one of the four sides of the container, the four sides of the container being then assembled and fastened to each other to form the cover, the body and the bottom and the emptying spout of the container.

5. The method according to claim 1, wherein the portion (9) of substantially trapezoidal shape of the cover panel (2) is configured so as to form a substantially planar or horizontal portion of the cover of the container.

6. The method according to claim 5, wherein the main panels (1) and the cover panels (2) are cut individually and a main panel is then assembled and fastened to a cover panel to form one of the four sides of the container, the four sides of the container being then assembled and fastened to each other to form the cover, the body and the bottom and the emptying spout of the container.

7. The method according to claim 1, wherein the main panels (1) and the cover panels (2) are cut individually and a main panel is then assembled and fastened to a cover panel to form one of the four sides of the container, four sides of the container being then assembled and fastened to each other to form the cover, the body and the bottom and the emptying spout of the container.

8. The method according to claim 1, wherein the tabs (5) continuing the extensions of the main panels are further intended to form an emptying spout (17), said tabs being assembled accordingly, the lower ends of the tabs being left free so as to form a lower opening of emptying spout, substantially square in shape.

9. The method according to claim 1, wherein the fold is transversely divided into several portions by openings pierced through the main panel so as to form a determined number of loops per main panel and a belt forming a continuous ring around the container is passed through the loops.

10. The method according to claim 1, wherein the cutting is made using ultrasounds or by means of a hot blade, and the fixation of the fold and the fastening of the panels correspond to a seaming operation.

11. A large-capacity flexible container, comprising:

a body and, downwards, a bottom with an emptying spout, and upwards, a cover, the cover including a filling spout having an upper spout opening that is substantially square in shape, said body, said bottom and said emptying spout resulting from the cutting out from a sheet of flexible material four main panels (1), each of the main panels having in part a square or rectangular shape (3) with four sides, comprising two lateral sides (7), one upper side (8) and one lower side, a shape whose lower side is continued by a substantially trapezoidal extension (4) whose downward apex is continued by a tab (5), the extension and the tab being intended to form the bottom and the emptying spout of the container, said cover and said filling spout resulting from cutting out from a sheet of flexible material four cover panels (2), each of the cover panels having in part a substantially trapezoidal shape (9) with a downward base and whose upward apex is continued by a tongue (10), the tongue being intended to form the filling spout extended upwards, said main and cover panels having been assembled and fastened to each other so that the base of each cover panel is assembled to the upper side of the corresponding main panel, the main panels having been assembled two-by-two at least along their lateral sides and their corresponding extensions, the lateral sides in correspondence of the cover panels having been assembled two-by-two to each other, and wherein each main panel includes a fold (6) of the sheet of flexible material constituting it, said fold being along the upper side of said main panel while being on the outside of the body and fixed to form at least one loop intended to form fixation means of the loop type intended to receive a belt.

12. A packaging, comprising externally a large-capacity flexible container according to claim 11, and internally, a tight inner protective envelope including an opening in relation with the filling spout of the cover.

13. The packaging of claim 12, wherein the packaging is placed in a metal frame and is maintained unfolded in said metal frame by loops made in main panels forming the body of the flexible container and by a belt forming a continuous ring around the container that is passed through the loops.

* * * * *